US007049968B2

(12) United States Patent
Fitzgerald et al.

(10) Patent No.: US 7,049,968 B2
(45) **Date of Patent: *May 23, 2006**

(54) BABY MONITOR WITH A SOOTHING UNIT

(75) Inventors: Karen Fitzgerald, Elma, NY (US); Domenic T. Gubitosi, East Aurora, NY (US); Mark H. Weppner, Williamsville, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/885,521

(22) Filed: Jul. 6, 2004

(65) Prior Publication Data

US 2005/0035864 A1 Feb. 17, 2005

Related U.S. Application Data

(63) Continuation of application No. 09/970,022, filed on Oct. 4, 2001, now Pat. No. 6,759,961.

(51) Int. Cl.
*B08B 23/00* (2006.01)

(52) U.S. Cl. ..... 340/573.1; 340/573.4; 340/539.1; 340/539.15; 340/568.1; 340/568.6; 382/94.1; 382/94.7

(58) Field of Classification Search ..... 340/573.1, 340/573.4, 539.1, 539.15, 568.1, 568.6; 446/227, 446/175; 381/94.1, 94.7
See application file for complete search history.

(56) References Cited

U.S. PATENT DOCUMENTS 4,285,028 A 8/1981 Sundin
4,858,079 A 8/1989 Ohashi
4,984,380 A 1/1991 Anderson
5,210,532 A 5/1993 Knoedler et al.
5,280,635 A 1/1994 Knoedler et al.
5,307,051 A * 4/1994 Sedlmayr ..... 340/573.1
5,387,146 A 2/1995 Smith et al.
5,446,934 A 9/1995 Frazier
5,555,891 A 9/1996 Eisenfeld
5,951,360 A 9/1999 Fearon et al.

(Continued)

FOREIGN PATENT DOCUMENTS

GB 2 322 952 A 9/1998

OTHER PUBLICATIONS

"Constant Care 3000™ Two-Way Communicator" Evenflo, Inc. Website, 1 page, www.evenflo.com/ep/bath_bed/care3000.phtml?nf.

*Primary Examiner*—Daniel Wu
*Assistant Examiner*—Tai T. Nguyen
(74) *Attorney, Agent, or Firm*—Cooley Godward LLP

(57) ABSTRACT

A baby monitor system with a parent unit communicable with a baby unit a soothing unit is provided. In an embodiment for the baby monitor system of the present invention, the baby unit is responsive to receiving a signal representative of an audible sound transmitted from the parent unit and the parent unit is responsive to receiving a signal representative of an audible sound transmitted from the baby unit. In an embodiment for a method of the present invention, a method for monitoring a baby is provided. The method includes the steps of receiving a signal representative of an audible sound at a baby unit from a parent unit, receiving a signal representative of an audible sound at a parent unit from a baby unit, and actuating a soothing unit included in the baby unit

31 Claims, 13 Drawing Sheets

U.S. PATENT DOCUMENTS 6,011,477 A 1/2000 Teodorescu et al.
6,043,747 A 3/2000 Altenhofen
6,066,161 A 5/2000 Parella
6,072,392 A 6/2000 Henderson et al.
6,084,527 A 7/2000 Spector
6,091,329 A 7/2000 Newman
6,113,455 A 9/2000 Whelan
6,116,983 A 9/2000 Long et al.
6,158,278 A 12/2000 Klinefelter
6,175,981 B1 1/2001 Lizama et al.
6,462,664 B1 * 10/2002 Cuijpers et al. ..... 340/573.1
6,593,851 B1 * 7/2003 Bornstein ..... 340/539.15

* cited by examiner

BABY MONITOR WITH A SOOTHING UNIT

This application is a continuation application of application Ser. No. 09/970,022 (Now U.S. Pat. No. 6,759,961), filed Oct. 4, 2001, the entire content of which is hereby incorporated by reference.

BACKGROUND

1. Field of the Invention

The present invention relates generally to baby monitors, and more particularly, to two-way communication baby monitors with a soothing unit.

2. Discussion of the Related Art

Two-way communication baby monitors are known. Additionally, crib entertainment devices are also known. Parents frequently wish to monitor their child's activity while not within an audible range of the child. Baby monitors have been used to provide such a function. Baby monitors have been developed that allow two-way communication so that a parent may talk to the infant being monitored to reassure or soothe the infant. Entertainment devices, such as mobiles, have also been configured to provide a one-way monitoring function as well as to provide remotely operated entertainment features.

These two-way monitoring devices and entertainment devices typically exist as separate units in a child's room. For example, the baby unit of the monitor is typically located in the child's room in some area near the crib, while the entertainment device is typically a separate unit that is attached to the crib.

Because these units are separate, parents are required to maintain the operation of each unit and to keep track of the various monitors and controllers that are associated with each product. Moreover, infant's rooms often have limited space and multiple devices create unwanted clutter. Whereas there have been attempts to overcome this problem by placing monitors and entertainment devices in cribs or suspended above cribs, there is a need for a baby monitor capable of providing two-way communication as well as having soothing features that are part of a single baby unit.

SUMMARY OF THE INVENTION

A baby monitor system with a parent unit communicable with a baby unit having a soothing unit is provided. In an embodiment for the baby monitor system of the present invention, the baby unit is responsive to receiving a signal representative of an audible sound transmitted from the parent unit and the parent unit is responsive to receiving a signal representative of an audible sound transmitted from the baby unit.

In an embodiment for a method of the present invention, a method for monitoring a baby is provided. The method includes the steps of receiving a signal representative of an audible sound at a baby unit from a parent unit, receiving a signal representative of an audible sound at a parent unit from a baby unit, and actuating a soothing unit included in the baby unit.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
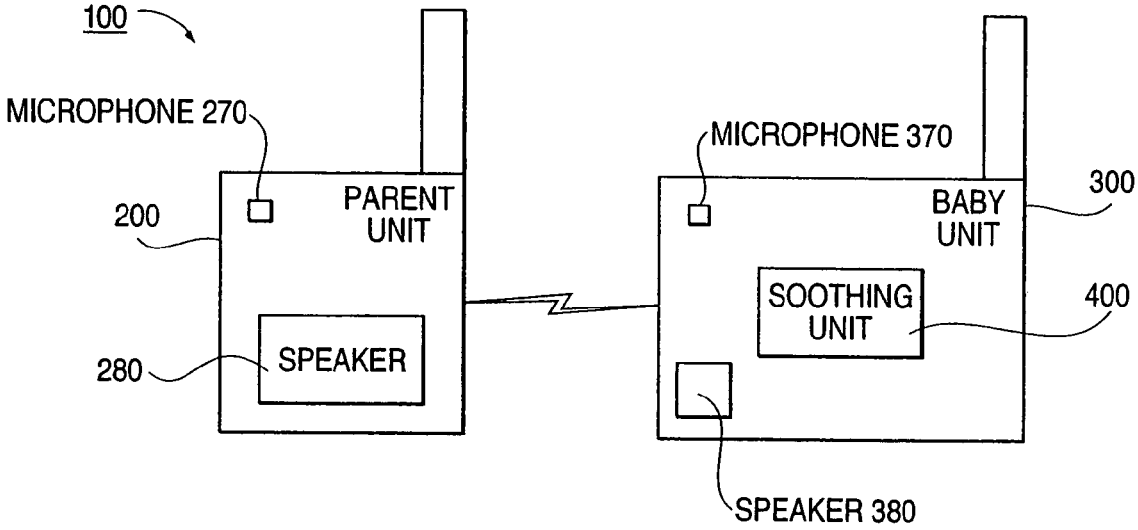
FIG. 1 is a schematic illustration of a baby monitor system in accordance with the principles of the present invention.

FIG. 1 is a schematic illustration of a baby monitor system 100 in accordance with the principles of the present invention. The assembly 100 includes a parent unit 200 and a baby unit 300. The parent unit 200 is used remotely by a user to monitor the sounds of the environment in and around where a child is located and to transmit sounds to the baby unit 300. The parent unit 200 is additionally used to activate soothing features on the baby unit 300. The baby unit 300 is positioned proximate to a child to receive and transmit sounds in the baby's environment.

As such, the baby unit 300 is two-way communicable with the parent unit 200. The baby unit 300 is responsive to receiving a signal representative of an audible sound transmitted from the parent unit 200 and the parent unit 200 is responsive to receiving a signal representative of an audible sound transmitted from the baby unit 300. The parent unit 200 includes a microphone 270 that receives audible signals from a user and a speaker 280 that produces audible sound received from the baby unit 300. Similarly, the baby unit 300 includes a microphone 370 that receives audible signals from the baby and a speaker 380 that produces audible sound received from the parent unit 200.

As mentioned above, the baby unit 300 also includes a soothing unit 400. The soothing unit 400 produces a variety of soothing lights and/or sounds to soothe a child located near the baby unit 300. The soothing unit 400 may be actuated by a control signal received from the parent unit 200. Optionally, the soothing unit 400 may be actuated locally (e.g., by a switch on the baby unit 300).

Figure 2:
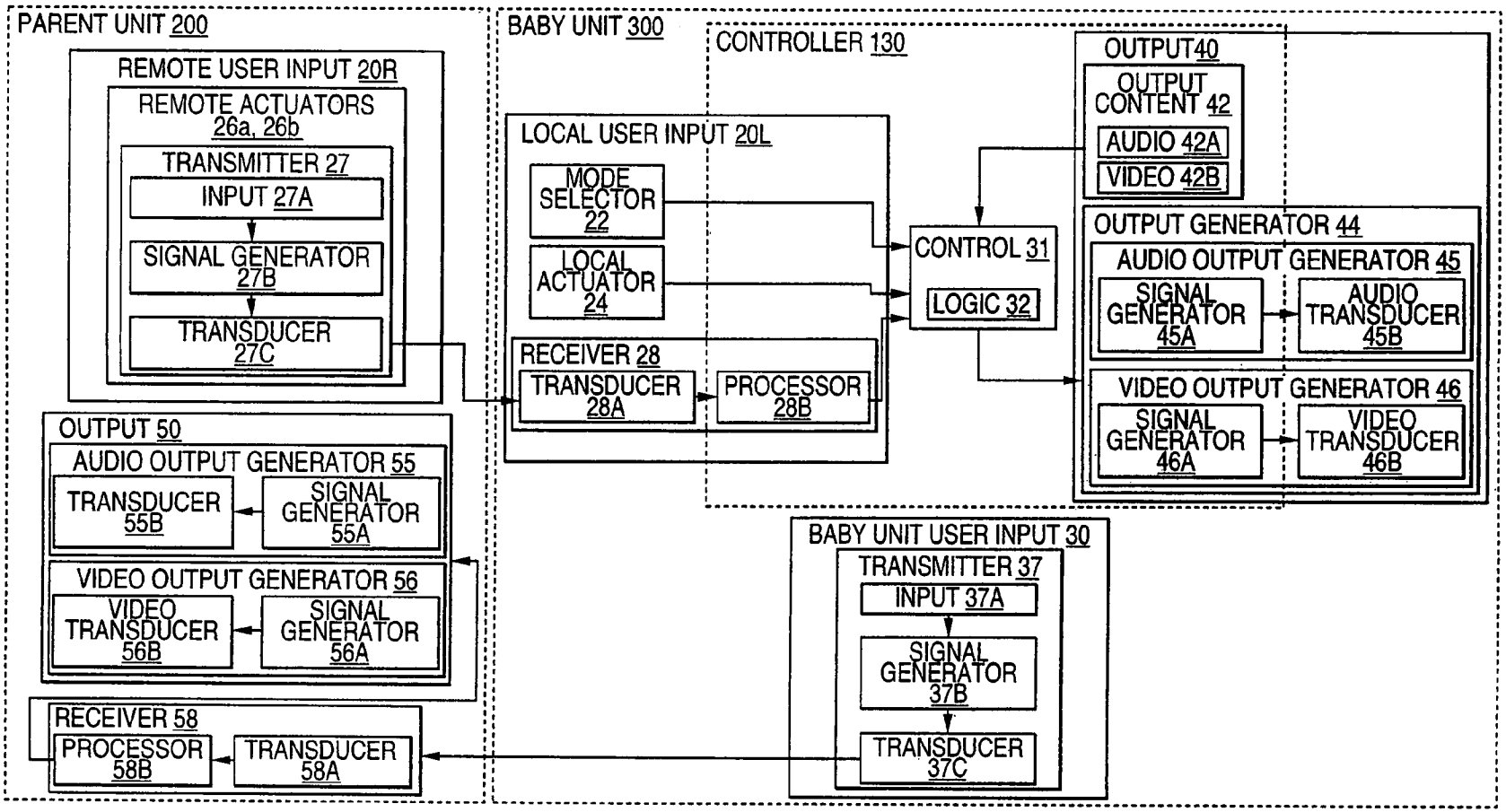
FIG. 2 is a functional block diagram of an embodiment of a baby monitor system.
Figure 3:
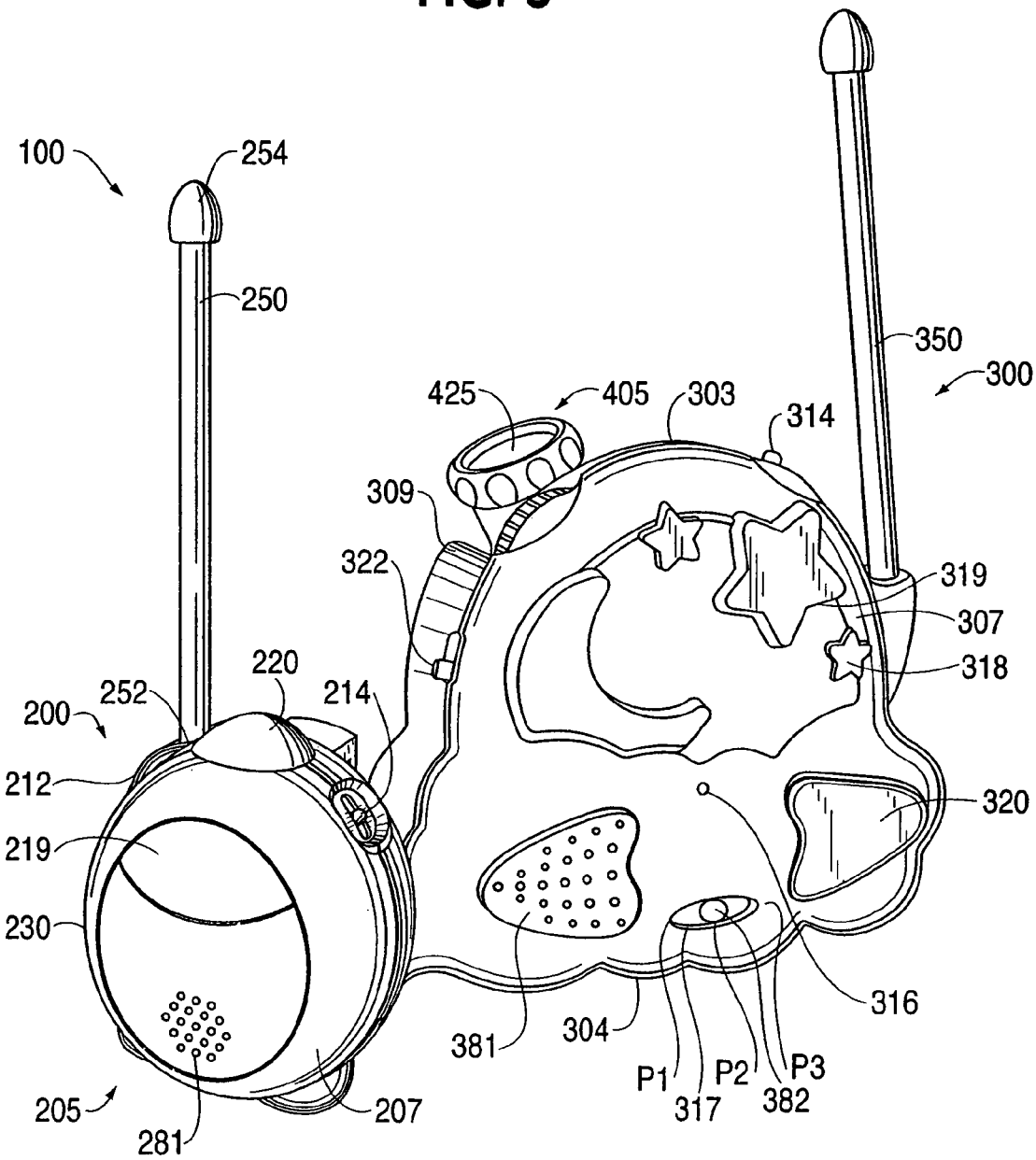
FIG. 3 is a perspective view of a first physical embodiment of a baby monitor system according to the present invention.
Figure 4:
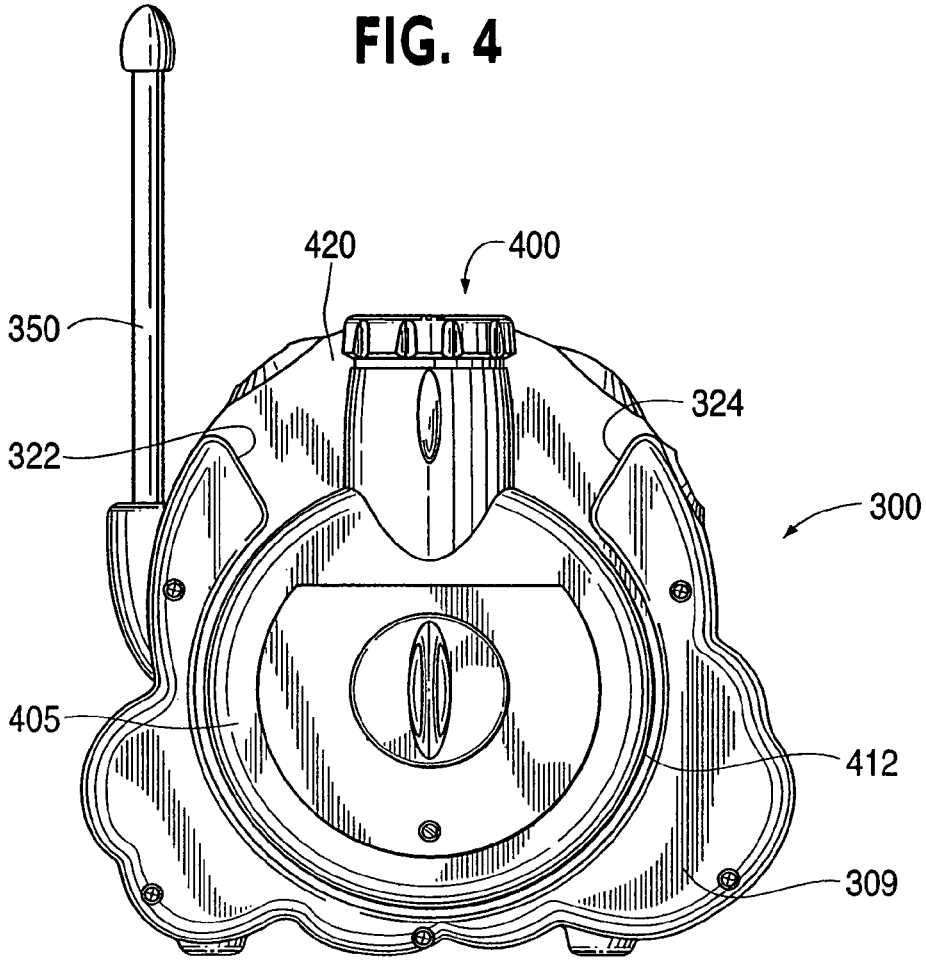
FIG. 4 is a rear perspective view of the baby unit of the system illustrated in FIG. 3.
Figure 5:
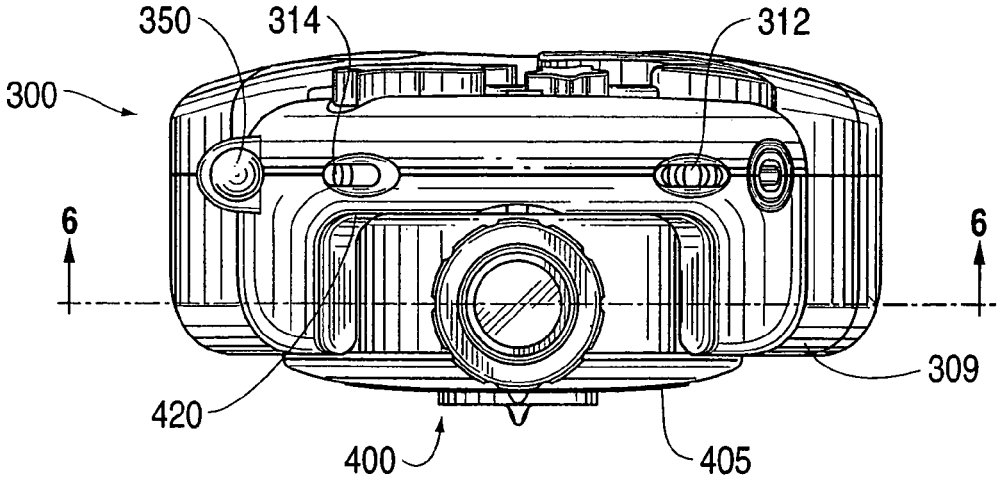
FIG. 5 is a top perspective view of the baby unit of the system illustrated in FIG. 3.
Figure 6:
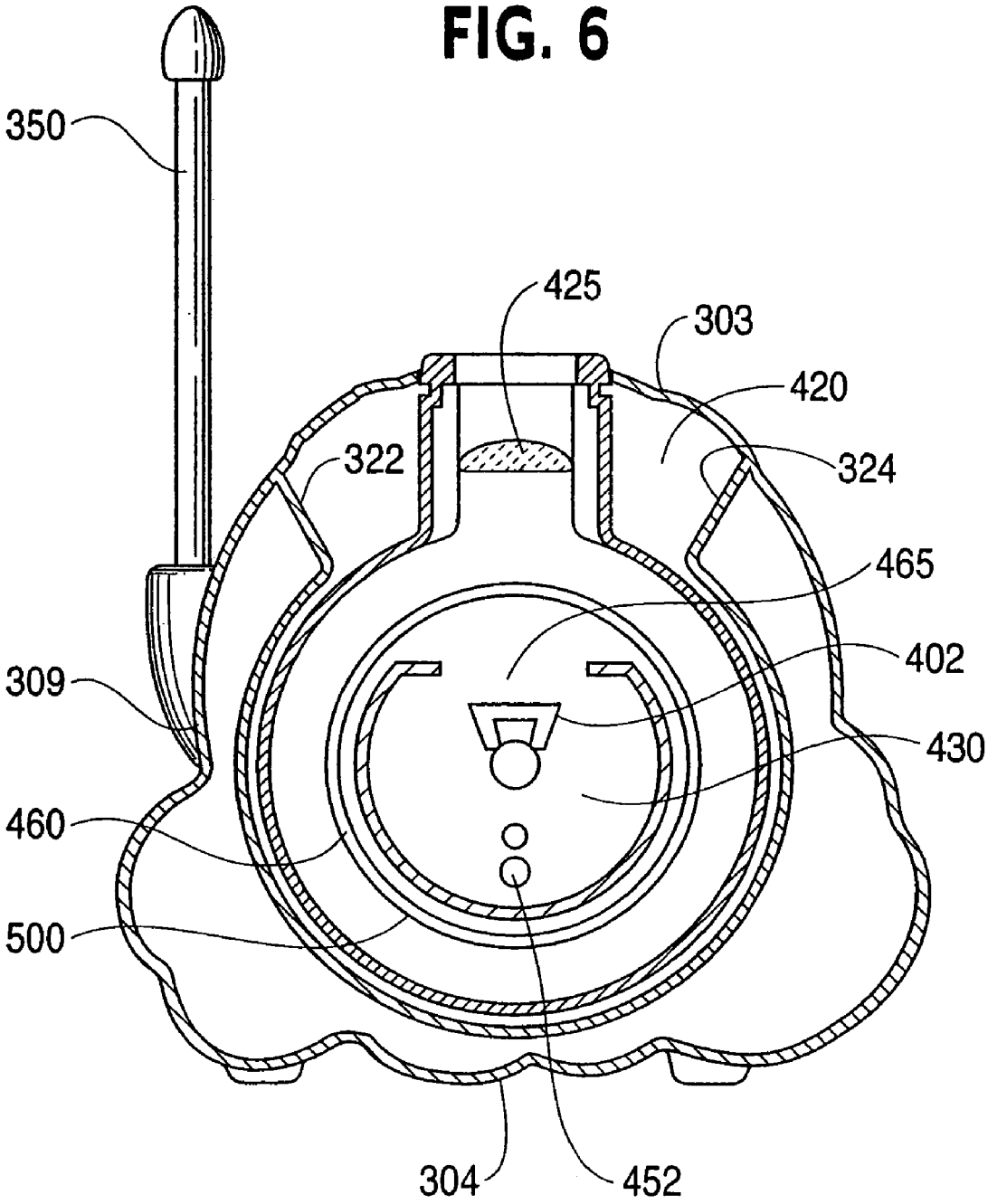
FIG. 6 is a cross-sectional view of the baby unit of the system illustrated in FIG. 3 as taken along line 6—6 in FIG. 5.
Figure 7:
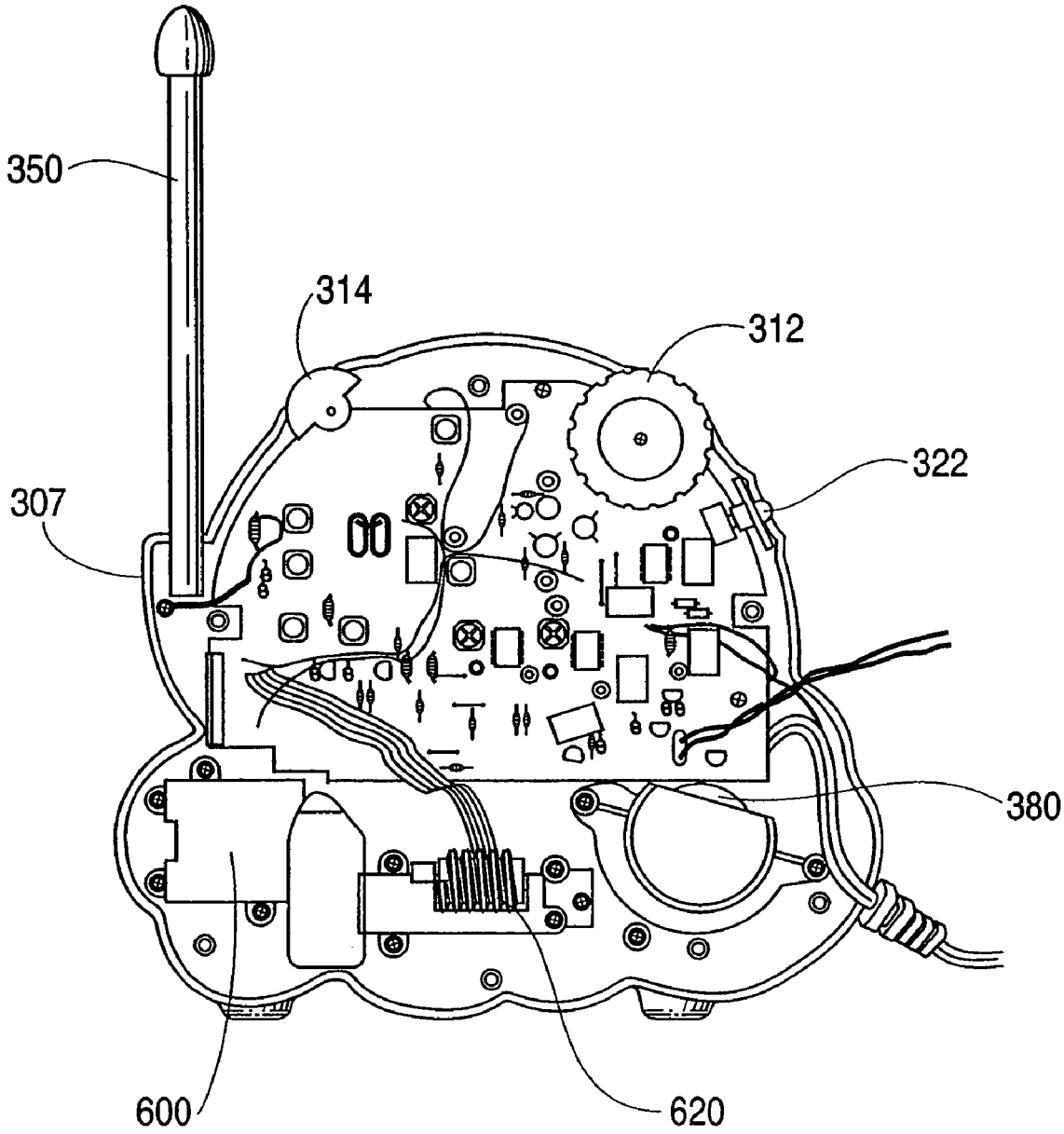
FIG. 7 is a first perspective view illustrating various internal components of the baby unit of the system illustrated in FIG. 3.
Figure 8:
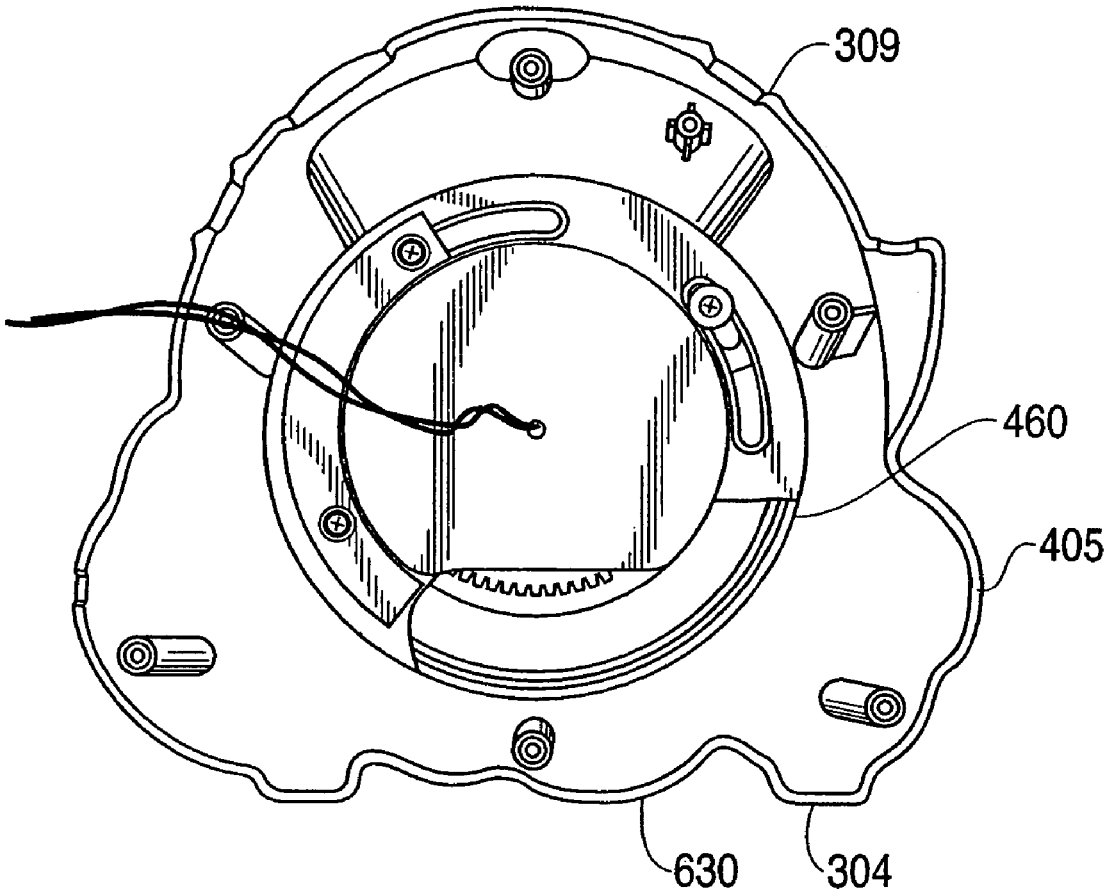
FIG. 8 is a second perspective view illustrating other various internal components of the baby unit of the system illustrated in FIG. 3.

FIG. 2 is a functional block diagram of the baby monitor system 100 of the present invention. The baby monitor system 100 includes a remote user input module 20R, a local user input module 20L, a baby unit user input module 30, a baby unit controller 130, a baby unit output module 40, and a parent unit output module 50. These various modules will be described in further detail below. In response to user input via either the remote user input module 20R or local user input module 20L, the controller 130 controls the output of selected baby unit output 40 (i.e., the operator selected soothing features), such as musical notes, sound effects, light patterns or combinations of musical notes and light patterns, from the output module 40. Likewise, the controller 130 controls the output of communication received from the parent unit 200 (e.g., the parent's voice transmitted to the baby unit 300).

Baby unit output module 40 (implemented as soothing unit 400 which is further described below) includes output content 42, which includes audio content 42A and video content 42B. Audio content 42A can include, for example, in either digital or analog form, musical tones (which can be combined to form musical compositions), speech (recorded or synthesized), or sounds (including recorded natural sounds, or electronically synthesized sounds). Video content 42B can include, for example, in analog or digital form, still or video images, or simply control signals for activation of lamps or other light-emitting devices.

The output content can be communicated to an infant for hearing or viewing by baby unit output generator 44, which can include an audio output generator 45 and a video output generator 46. Audio output generator 45 can include an audio signal generator 45A, which converts audio output content 42A into signals suitable for driving an audio transducer 45B, such as a speaker, for converting the signals into audible sound waves. Video output generator 46 can include a video signal generator 46A, which converts video output content 42B into signals suitable for driving a video transducer 46B, such as a display screen, lights, or projected images, for converting the signals into visible light waves. Video output generator 46 can also include moveable physical objects, such as miniature figures, to produce visual stimulus to the infant. The selection of the output content 42 by the user, and the performance attributes of the output generators, should be informed by the goal of generating output that is appealing or soothing to an infant. Audio volume levels should be selected to soothe, rather than startle, the infant. Audio content should be soothing, pleasing, comforting, and/or rhythmic or melodic. Video output intensities should be high enough such that the video output is visible to the baby in a darkened room, but low enough such that the baby is not kept awake. Video output should also be pleasing and include familiar static or animated patterns or images, or rhythmically repeated abstract patterns or images.

Controller 130 includes control module 31 which controls output module 40, responsive to user input modules 20R, 20L, for accessing the output content to be output and activating the output generator 44 to operate on the selected and accessed output content 42. The operation of control module 31 can be governed by control logic 32, which can be, for example, computer software code. The video and audio output can be coordinated to enhance the pleasing effect.

Local user input module 20L includes a mode selector 22 and a local actuator 24. Mode selector 22 allows the user to select from among various output modes of soothing features for viewing and/or hearing by the baby. Illustrative output modes include combined video and audio output, audio-only output, and video-only output. For example, one selected output mode could include both audio content 42A, which can include a set of musical tones and a set of sound effect segments, and video content 42B, which can include a selected sequence of illumination instructions for lamps or dynamic images. The local actuator 24 allows the user to input "start," or "stop," commands via, for example, mechanical contact switches. Local actuator 24 is physically located on the baby unit 300.

Control logic 32 includes sets of sequences in which the musical tones can be output to produce recognizable tunes. A program can include a predetermined sequential output of the sets of tone sequences, producing a sequence of musical tunes. Lamps can be illuminated in response to a set of illumination instructions correlated with the playing of the tunes. A program may also include output of a single one of the sets of tone sequences, producing one musical tune, also with coordinated lights. A sound effects program can include output of a single one of the sound effect segments.

Remote user input module 20R includes remote actuators 26*a* and 26*b*, by which the user can provide input to control module 31 to access the selected output content and to initiate its output. Remote actuator 26*a* also allows the user to input "start," or "stop," commands via, for example, mechanical contact switches. Remote actuator 26*b* allows the user to transmit spoken words through a microphone, to ultimately be transmitted to the baby unit 300. Remote actuators 26*a*, 26*b* include a transmitter portion 27 physically located on the parent unit 200. A corresponding receiver portion 28, which receives signals from remote actuators 26*a*, 26*b*, is physically located on the baby unit 300. A command signal can be communicated between the transmitter portion and the receiver portion without a physical link, such as an electromagnetic signal (including infrared and radio frequency) or an acoustical signal (including ultrasonic), or with a physical link, such as an electrical signal carried by a conductor coupling the transmitter portion and the receiver portion.

The transmitter 27 is capable of receiving verbal input 27A from the user (e.g., a parent) and has a signal generator 27B to generate a signal that is transmitted to receiver 28 in the baby unit 300. The receiver 28 processes the received signal and outputs an audio signal representative of the user's spoken words. The audio signal is output by audio output generator 45 that includes signal generator 45A, which converts the received audio signal to signals suitable for driving the audio transducer 45B.

The baby unit user input module 30 includes a transmitter portion 37 that receives a verbal input 37A from the user (e.g., a crying infant) and has a signal generator 37B to generate a signal that is transmitted via transducer 37C to a receiver 58 in the parent unit 200. The receiver 58 processes the received signal and outputs an audio signal and a corresponding video signal. The receiver 58 includes a transducer 58A and a processor 58B. The output 50 can include an audio output generator 55 and a video output generator 56. Audio output generator 55 can include an audio signal generator 55A, which converts the received signal to signals suitable for driving an audio transducer 55B, such as a speaker, for converting the signals into audible sound waves. Video output generator 56 can include a video signal generator 56A, which converts the received signal into signals suitable for driving a video transducer 56B, such as an array of LEDs. The array of LEDs is illuminated in such a manner that the number of LEDs that are illuminated corresponds to the strength of the signal received from baby unit user input module 30.

To use the baby monitor system 100, a user places the infant to be soothed within an operative range of the output generator 44. The user selects an output mode for the soothing features with mode selector 22, and issues a "start" command via either local actuator 24 or remote actuator 26*a*. The control module 31 receives the mode selection and the start command, accesses the output content 42 corresponding to the mode selection, and activates the output generator 44 to output the selected output content. Use of the remote actuator 26*a* to issue the start command allows the user to be positioned remote from the infant, so that the soothing output can be initiated while minimizing the risk that the user will disturb, or attract the attention of, the infant.

Figure 9:
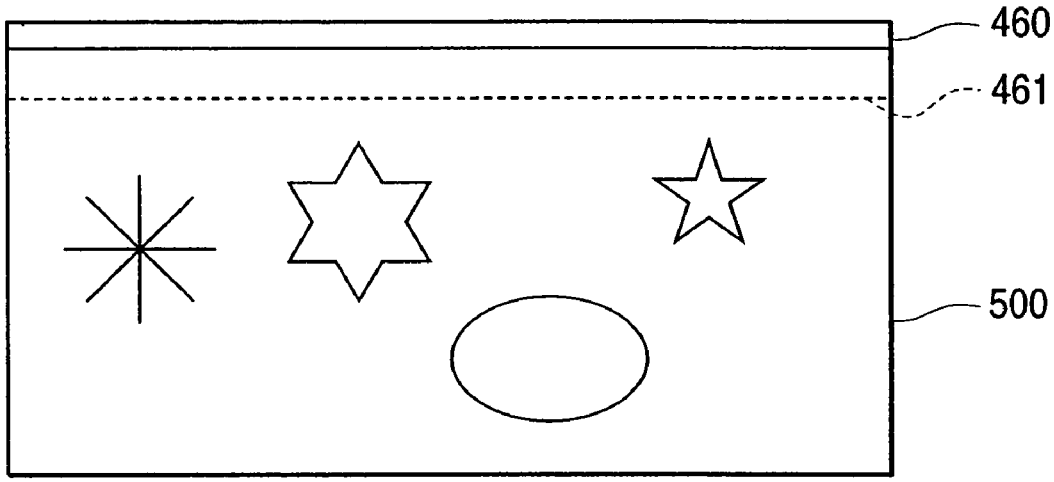
FIG. 9 is a top view of a film guide disk and associated film of the baby unit of the system illustrated in FIG. 3.
Figure 10:
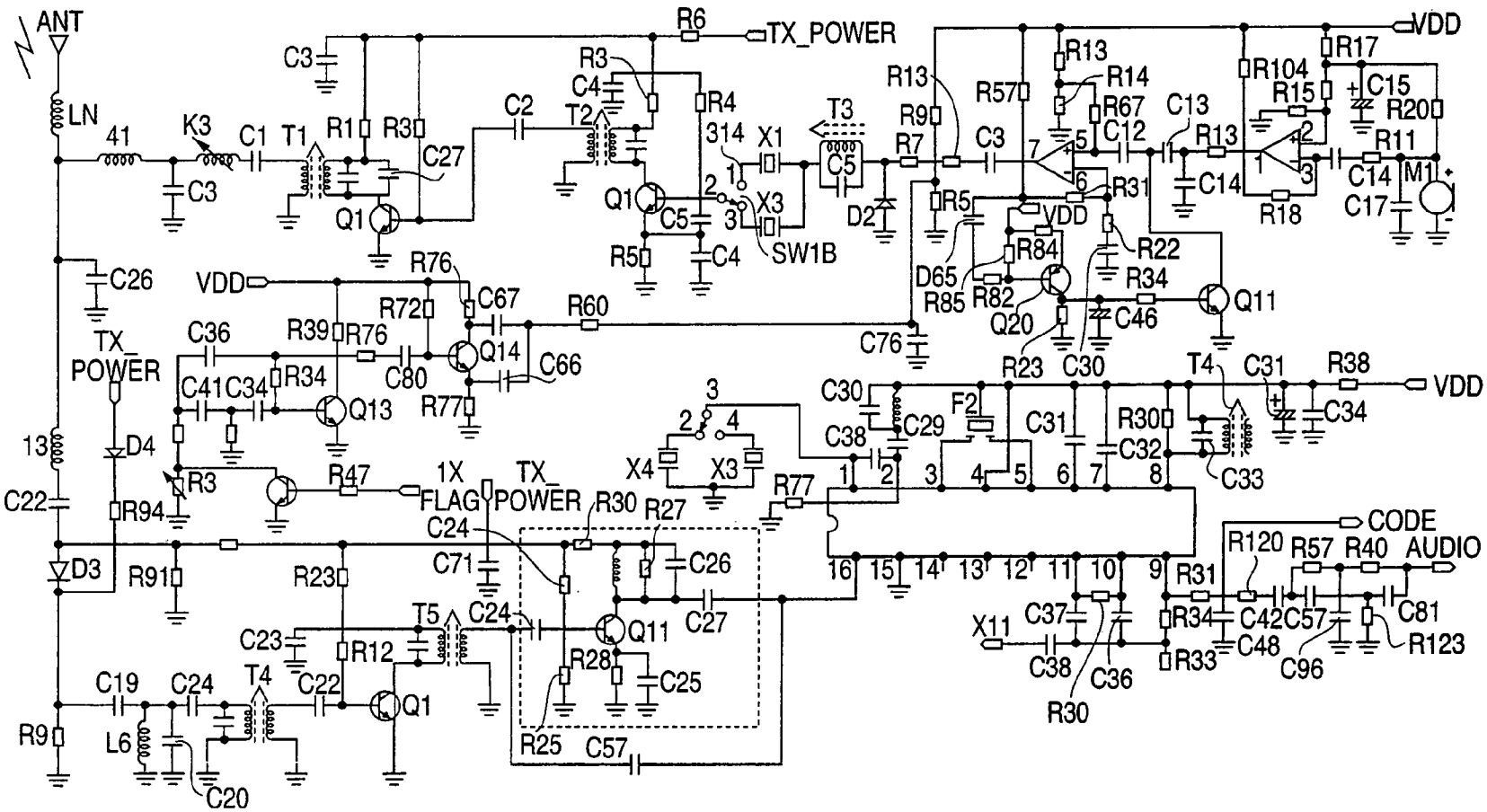
FIG. 10 is a schematic illustration of a receiver portion of the electrical circuit of the baby unit of the system illustrated in FIG. 3.
Figure 11:
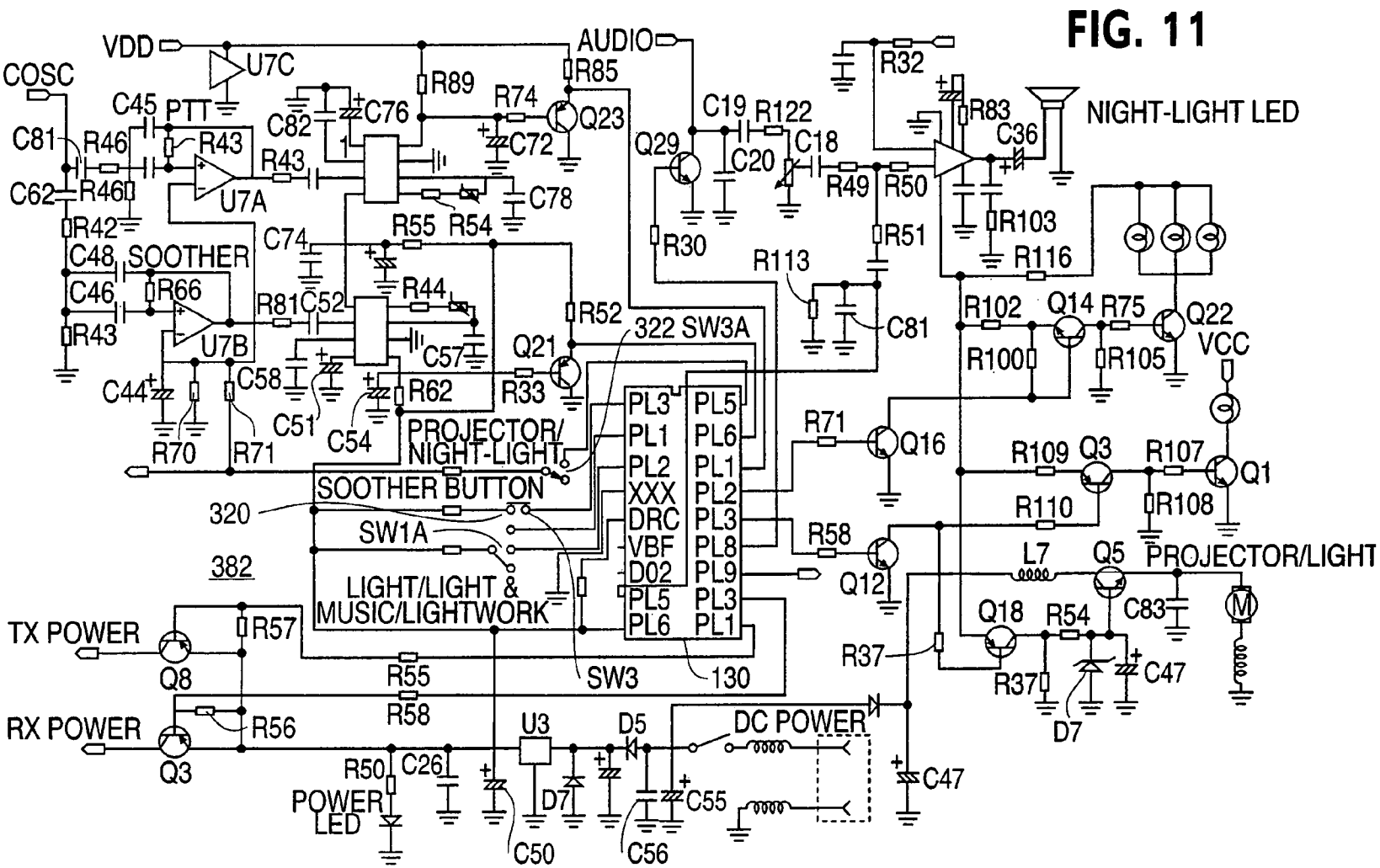
FIG. 11 is a schematic illustration of a transmitter portion of the electrical circuit of the baby unit of the system illustrated in FIG. 3.
Figure 12:
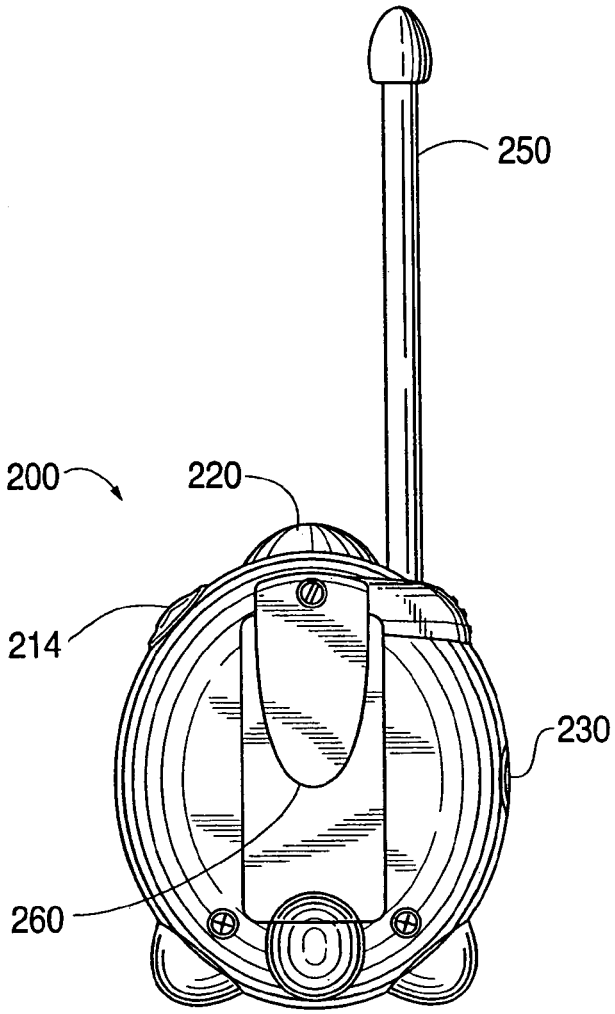
FIG. 12 is a rear perspective view of the parent unit of the system illustrated in FIG. 3.
Figure 13:
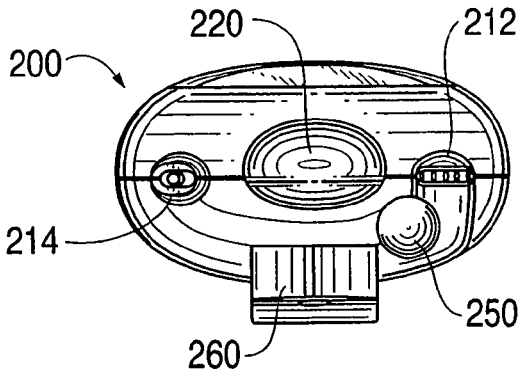
FIG. 13 is a top perspective view of the parent unit of the system illustrated in FIG. 3.
Figure 14:
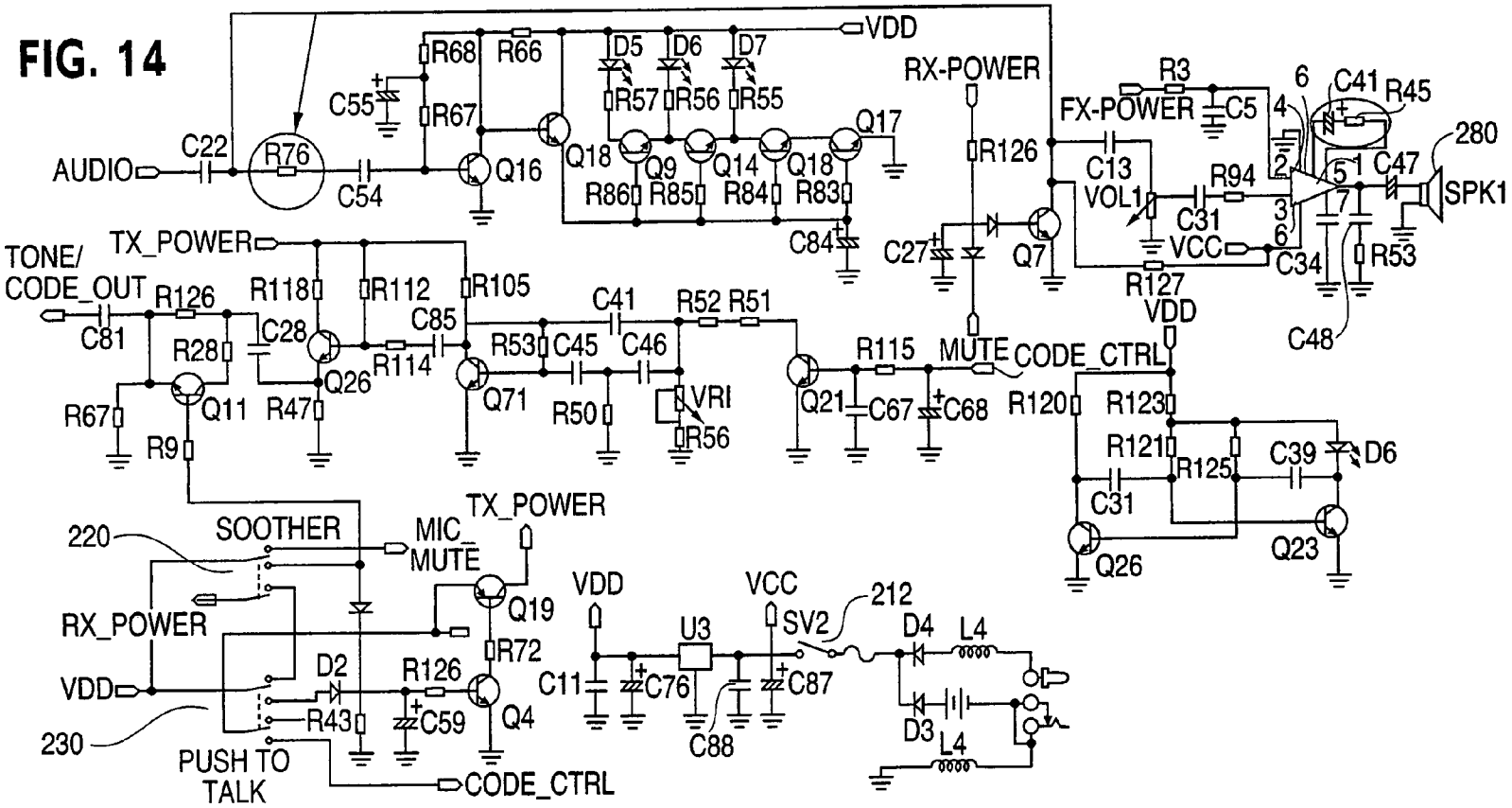
FIG. 14 is a schematic illustration of the electrical circuit of the parent unit of the system illustrated in FIG. 3.

A first physical implementation of an embodiment of the present invention is now described with reference to FIGS. 3 to 14. As described previously, baby monitor system 100 includes a parent unit 200 and a baby unit 300. The correspondence between the fictional elements and the parent and baby units is illustrated in FIG. 2 by phantom-lined boxes, identified as parent unit 200 and baby unit 300, drawn around the functional elements. Electrical schematic illustrations of the baby unit 300 are shown in FIGS. 10 and 11 and an electrical schematic illustration of the parent unit 200 is shown in FIG. 14.

As shown in FIGS. 3–9, the components of the baby unit 300 are contained and supported in a housing 305. Baby unit housing 305 is composed of front and rear housing portions 307, 309. Baby unit housing 305 has a top portion 303 and includes a substantially planar base 304, upon which the baby unit 300 may be positioned on a support structure, such as a dresser, changing table, or nightstand, in operative proximity to an infant sleeping area. The rear portion 309 of baby unit housing 305 further includes a cavity 420 for receiving the soothing unit 400 and stopping surfaces 322, 324 for defining the range of motion of the soothing unit 400 as will be described in detail below.

In the illustrated embodiment, the soothing unit 400 may include a light unit or nightlight 318 that is located on the front portion 307 of the housing 305 and includes Light Emitting Diodes (LEDs) to provide an appropriate level of illumination. A translucent screen 319 is provided in front of the LEDs to provide color and pattern to the light. The screen includes images that are pleasing to a child such as stars and moons.

The video output generator 46 is also incorporated as part of the soothing unit 400 and includes a projector 405 that directs an image that is pleasing to a child onto a surface spaced apart from the baby unit 300 such as a ceiling or wall. The projector 405 is pivotally coupled to the housing 305 within cavity 420 and is able to rotate so that the projected image can be directed to multiple positions without having to move the baby unit 300. In this manner, the baby unit 300 can be situated on a support surface adjacent a crib or bed while the image is projected directly above the crib to provide a soothing and entertaining effect for the child positioned in the crib. The arc of rotation of the projector 405 is defined by stopping surfaces 322, 324 and the projector 405 is able to lock into multiple positions along the arc of rotation. The projector 405 may lock in-place through the use of a detent mechanism, as is known by those skilled in the art.

Referring to FIGS. 4–9, further description of the operation of the projector 405 will now be provided. The projector 405 projects an image on a surface spaced from the projector by shining a light through a film 500 and projecting an image on the film through a lens 425 to project the image onto an opposing surface. A light bulb 402 is housed within a cavity 430 inside projector 405. Contacts 452 are provided within cavity 430 for supplying current to the bulb. The bulb may be coupled to the inner surface of cover 412 of projector 405 such that when the cover is removed from the projector 405, the light bulb is easily removed. The light bulb is positioned to shine through an opening 465 within the projector 405 such that it passes through the film 500. The film 500 is coupled to a film guide disk 460 that rotates such that the film 500 passes by the opening 465 to give the appearance that the projected image is moving.

The film guide disk 460 is a substantially circular disk with a flat outer surface that is capable of retaining an edge of the film 500. As illustrated in FIG. 9, the film 500 extends out past an outer edge 461 of the disk 460 such that an image on the film is unobstructed by the disk 460 as it passes over the opening 465. In this manner, the light may shine through the opening 465 and through the film 500, unobstructed by the guide disk 460, to project the image on the film 500 onto a surface in the baby's room. The guide disk 460 is rotated by a series of gears 620, 630 that are driven by a motor (not visible) contained within motor housing 600.

The baby unit 300 may be turned on and off via power switch 312. A power indicator 316 is provided on front housing portion 307 to indicate whether or not power is being supplied to the unit. Various modes of operation of the baby unit 300 are alternatively selected by mode selector 322 and mode selector 382. Via mode switch 322, implemented as switch SW3A as can be seen in FIG. 11, the user may select which video output (i.e., nightlight or projector) is provided at the baby unit 300. Via mode switch 382, implemented as switch SW1A, which can also be seen in FIG. 11, the user selects a combination of sound effects, music and/or lights, as selected, (e.g., night light or projector) that will be played during operation of the unit. In a mode of operation, when the switch SW1A is in a first position at location P1 in switch cavity 317 in front housing portion 307, controller 130 causes no music or sound effects, but the projector or nightlight will operate. When switch SW1A is in a second position at location P2, the controller 130 will cause the projector or the nightlight to operate and music will be played. A number of musical selections may be incorporated in the device. When the switch SW1A is in a third position at location P3, sound effects, such as waves or crickets, will be played and the projector or the nightlight will operate.

The baby unit 300 also includes an actuator 320 that may be used to activate the soothing unit 400. Actuator 320 is implemented as a button in the front housing 307 of the baby unit 300, which, when depressed by the user, closes a switch SW3 (see FIG. 11) and sends a corresponding input signal to the controller 130. Each actuation of the local soothing actuator 320 causes the soothing unit 400 to turn on or off. When the mode switch SW1A is at location P2, each successive actuation of the soothing actuator will cause a different melody to be played. As discussed above, a variety of melodies may be stored in controller 130. The baby unit 300 is further provided with a channel selector switch 314 (implemented as switch SW1B in FIG. 10) to choose a two-way communication channel between the baby unit 300 and the parent unit 200. The availability of multiple communication channels allows the user to select a channel that is not subject to interference by other electronic devices in the home.

The soothing unit 400 also includes a speaker 380 mounted in the baby unit housing 305 behind a perforated speaker grill 381. The speaker is a 2.25 inch (5.715 cm) diameter driver, and is preferably driven to a sound pressure level of less than approximately 90 dB at 12 inches from the front of the speaker source. The speaker 380 is used to transmit audio output such as music and sound effects from the soothing unit as well as voice signals received from the parent unit 200. Optionally, different speakers may be used for each type of output.

An embodiment of the parent unit 200 will now be described with reference to FIGS. 3, and 12–14. The parent unit 200 is compact in size to make it readily portable and less cumbersome. The parent unit may be provided with a clip 260 to attach to, for example, the belt of the user such that the parent unit 200 may be easily transported. The components of the parent unit 200 are contained and supported in a housing 205. The front portion 207 of the housing 205 includes a window 219 through which illuminated light emitting diodes may be viewed. The parent unit may be provided with either A/C or D/C power.

The parent unit 200 may be turned on, and the volume may be adjusted; via power switch 212 (implemented as switch SW2 in FIG. 14). The audio output generator 55 of the parent unit includes a speaker 280 mounted within the parent unit 200 behind a speaker grill 281. The speaker is a 1.5 inch (3.81 cm) diameter driver, and is preferably driven to a sound pressure level of less than approximately 100 dB at 12 inches from the front of the speaker source. The parent unit 200 further includes a channel selector switch 214 to choose a communication channel between the baby unit 300 and the parent unit 200.

The parent unit 200 also includes remote user input module 20R, as described previously, via which the user can provide input to the baby unit 300 for effecting operation of the baby unit 300. The remote user input module 20R is implemented as remote soothing actuator 220 (implemented as switch SW3 in FIG. 14) and a talk actuator 230 (implemented as switch SW5 in FIG. 14). When the soothing actuator 220 is depressed, switch SW3 closes and sends a corresponding signal to the controller 130 via antenna 250. The remote soothing actuator 220 functions in a manner similar to the local soothing actuator 320 on the baby unit 300, providing only start and stop signals to controller 130, as described above, for turning the soothing unit 400 on and off.

When the talk actuator 230 (switch SW5) is depressed, the user may speak into a microphone (not visible) and a signal representative of the user's spoken words is transmitted to the baby unit 300 and ultimately output at speaker 380, as was also described above. When switch SW3 is not depressed, the microphone is muted and sounds will not be transmitted from the parent unit 200.

Figure 15:
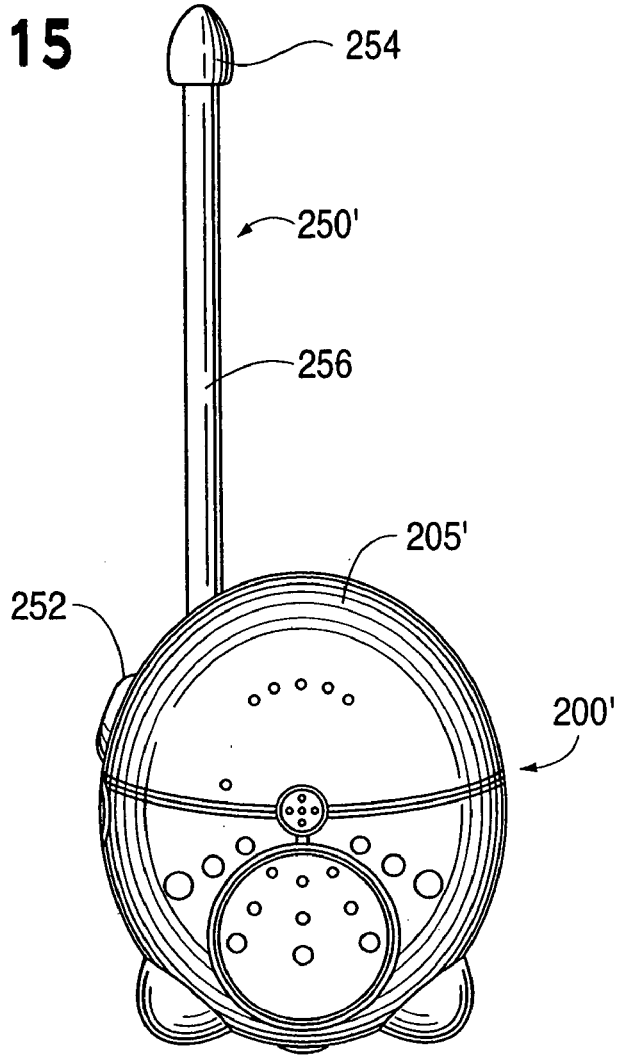
FIG. 15 is a front perspective view of a second physical embodiment of a parent unit in accordance with the principles of the present invention.
Figure 16:
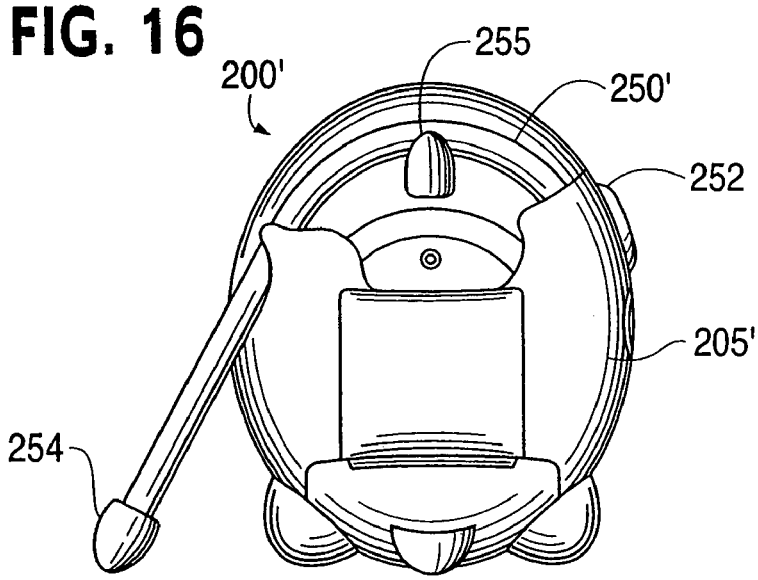
FIG. 16 is a rear perspective view of the parent unit of FIG. 15.

An alternative embodiment of the parent unit is illustrated in FIGS. 15 and 16. The parent unit 200' includes a housing 205' and a flexible antenna 250'. The flexible antenna has a proximal end 252 coupled to the housing and a distal end 254 with a body 256 extending therebetween. A retainer 255 is coupled to the housing 205' and is able to maintain the antenna in an alternative position adjacent the housing 205' of the parent unit 200'. The antenna 250' is reconfigurable between a first configuration where the body 256 is disposed away from the housing 205' and a second configuration (illustrated in FIG. 16) where the body 256 of the antenna 250' is disposed adjacent to the housing 205' within the retainer 255. As illustrated in FIG. 16, the antenna in the second position takes on a substantially arcuate configuration with the distal end 254 contacting the supporting surface on which the parent unit is situated. Alternatively, the antenna 250' may be shorter in length where, while still maintaining an arcuate configuration, the distal end 254 does not contact the supporting surface upon which the parent unit 200' is situated.

The retainer 255, which maintains the position of the antenna in its folded configuration, may be a detent in the body of the housing 205', as illustrated in FIG. 16. Optionally, the retainer 255 may be a clip (not shown) attached to the outside of housing 205'.

The reconfigurable antenna 250' of the alternative embodiment of the parent unit 200' desirably provides for reducing the volume required for the physical space where the parent unit 200' is positioned.

The reconfigurable antenna 250' may be manufactured from a variety of materials including, but not limited to, malleable plastic or rubber. Alternatively, the reconfigurable antenna 250' may be manufactured to include an internal flexible, reconfigurable member, constructed from either plastic or metal, which is surrounded by a flexible material.

In another embodiment of the invention, the microphone of the parent unit 200 and/or the baby unit 300 may be positioned on a distal end of the antennae 250, 350, respectively. In this manner, the output of the speaker 280, 380 would be less likely to interfere with user input at the parent unit 200 or the baby unit 300.

The various features of the invention have been described in relation to baby monitors. However, it will be appreciated that many of the features, such as the visual displays, the soothing unit, the remote control operation, and the two-way communication can be implemented on a variety of other children's products such as crib toys, stroller attachments, playpen attachments, etc. Moreover, variations and modifications exist that would not depart from the scope of the invention. A number of these variations have been set forth above, however, additional variations can be contemplated by those skilled in the art.

What is claimed is:

1. A baby monitor system, comprising:

a parent unit; and a baby unit including a soothing unit, said baby unit communicable with said parent unit, the soothing unit including a light source, an image projection unit, and a film disposed between said light source and said image projection unit;

said baby unit responsive to receiving a signal representative of an audible sound transmitted from said parent unit; and said parent unit responsive to receiving a signal representative of an audible sound transmitted from said baby unit.

2. The baby monitor system of claim 1, wherein said baby unit is responsive to receiving a control signal from said parent unit to actuate said soothing unit.

3. The baby monitor system of claim 1, wherein said soothing unit includes an audio output unit.

4. The baby monitor system of claim 1, said baby unit comprising a housing having a substantially planar base.

5. The baby monitor system of claim 1, wherein said film is rotatable.

6. The baby monitor system of claim 1, said parent unit comprising:

a housing;

a flexible antenna having a proximal end coupled to said housing, a distal end and a body extending therebetween; and a retainer coupled to said housing;

said antenna reconfigurable between a first configuration wherein said body is disposed away from said housing and a second configuration wherein said body is disposed adjacent to said housing within said retainer.

7. The baby monitor system of claim 6, wherein when said antenna is configured in said first configuration, said body is in a substantially straight configuration and wherein when said antenna is configured in said second configuration, said body is in an arcuate configuration.

8. The baby monitor system of claim 6, wherein said retainer includes a detent formed in said housing.

9. The baby monitor system of claim 6, wherein said retainer comprises a clip.

10. A baby monitor, comprising:

a baby unit including:

a transmitter configured to transmit a signal associated with an audible sound;

a housing;

a light source; and a projector, the light source being configured to project light through the projector, the projector being movably coupled to the housing and configured to move with respect to the housing from a first orientation to a second orientation different than the first orientation, the projector being configured to direct the projected light in a first direction with respect to the housing when the projector is in its first configuration and a second direction with respect to the housing different than the first direction when the projector is in its second configuration.

11. The baby monitor of claim 10, wherein the projector is pivotably coupled to the housing.

12. The baby monitor of claim 10, wherein the projector is configured to direct the projected light along a projection axis, the projector being pivotable with respect to the housing about an axis substantially perpendicular to the projection axis.

13. The baby monitor of claim 10, further comprising:

a remote actuator configured to actuate the light source of the baby unit.

14. The baby monitor of claim 10, further comprising:

a parent unit configured to actuate the baby unit, the parent unit being configured to receive the signal associated with an audible sound transmitted from the baby unit.

15. The baby monitor of claim 10, further comprising:

a parent unit configured to actuate the baby unit, the parent unit being configured to receive the signal associated with an audible sound transmitted from the baby unit, the baby unit being configured to receive a signal representative of an audible sound transmitted from the parent unit.

16. The baby monitor of claim 10, wherein the baby unit includes an audio output unit.

17. The baby monitor of claim 16, further comprising:

a parent unit configured to actuate at least one of the light of the baby unit and the audio output unit of the baby unit.

18. The baby monitor of claim 10, further comprising:

a film disposed between the light source and a distal end of the projector.

19. The baby monitor of claim 10, further comprising:

a film disposed between the light source and a distal end of the projector, the film being movable with respect to the light source.

20. A method of using a baby monitor, the baby monitor including a baby unit having a transmitter configured to transmit a signal associated with an audible sound, a housing, a light source, and a projector, the light source being configured to project light through the projector, the projector being movably coupled to the housing, comprising:

disposing the projector in a first orientation such that the projected light is configured to be projected at a first angle with respect to the housing; and moving the projector to a second orientation different than the first orientation such that the projected light is configured to be projected at a second angle with respect to the housing, the second angle being different than the first angle.

21. The method of claim 20, the baby monitor including a film disposed between the light source and a distal end of the projector, further comprising:

disposing the film in a first position with respect to the light source; and moving the film to a second position with respect to the light source different than the first position.

22. The method of claim 20, the baby monitor including a remote actuator configured to communicate with the baby unit, further comprising:

actuating the light source via the remote actuator.

23. The method of claim 20, further comprising:

transmitting a signal associated with an audible sound to a parent unit.

24. A baby monitor system, comprising:

a baby unit including:

a transmitter configured to transmit a signal associated with an audible sound;

a housing;

a light source; and a projector, the light source being configured to project light through the projector to a first location on a surface when the baby unit is in a first configuration, the light source begin configured to project light though the projector to a second location on the surface different than the first location when the baby unit is in a second configuration.

25. The baby monitor of claim 24, wherein the projector is movably coupled to the housing and configured to be disposed in a first position with respect to the housing when the baby unit is in its first configuration and a second position with respect to the housing different than the first position when the baby unit in its second configuration.

26. The baby monitor of claim 24, wherein the projector is pivotally coupled to the housing and configured to be disposed in a first position with respect to the housing when the baby unit is in its first configuration and in a second position with respect to the housing different than the first position when the baby unit in its second configuration.

27. The baby monitor of claim 26, wherein the projector is configured to direct the projected light along a projection axis, the projector being pivotable with respect to the housing about an axis substantially perpendicular to the projection axis.

28. The baby monitor of claim 24, further comprising:

a remote actuator configured to actuate the light source of the baby unit.

29. The baby monitor of claim 24, further comprising:

a parent unit configured to actuate the baby unit, the parent unit being configured to receive the signal associated with an audible sound transmitted from the baby unit.

30. The baby monitor of claim 24, further comprising:

a parent unit configured to actuate the baby unit, the parent unit being configured to receive the signal associated with an audible sound transmitted from the baby unit, the baby unit being configured to receive a signal associated with an audible sound transmitted from the parent unit.

31. The baby monitor of claim 24, further comprising:

a film disposed between the light source and a distal end of the projector, the film being movable with respect to the light source.

* * * * *

UNITED STATES PATENT AND TRADEMARK OFFICE

CERTIFICATE OF CORRECTION

PATENT NO. : 7,049,968 B2
APPLICATION NO. : 10/885521
DATED : May 23, 2006
INVENTOR(S) : Karen Fitzgerald et al.

It is certified that error appears in the above-identified patent and that said Letters Patent is hereby corrected as shown below:

Column 5
Line 21, replace “fictional” with --functional--.

Signed and Sealed this

Twelfth Day of September, 2006

JON W. DUDAS
*Director of the United States Patent and Trademark Office*